United States Patent [19]

Manfré

[11] 4,396,180

[45] Aug. 2, 1983

[54] HIGH CAPACITY DEVICE FOR THE PREPARATION OF A MIXTURE COMPRISING A SOLID PHASE AND A LIQUID PHASE OF A METAL ALLOY

[75] Inventor: Giovanni Manfré, Vinovo, Italy

[73] Assignee: Centro Ricerche Fiat S.p.A., Orbassano, Italy

[21] Appl. No.: 282,729

[22] Filed: Jul. 13, 1981

[30] Foreign Application Priority Data

Aug. 1, 1980 [IT] Italy ..... 68246 A/80

[51] Int. Cl.[3] ..... C22B 9/00

[52] U.S. Cl. ..... 266/233; 266/236; 222/606; 164/337; 164/362

[58] Field of Search ..... 266/236, 266, 267, 268, 266/270, 202, 233, 235; 239/501, 500; 164/337, 77, 362, 133, 485; 222/606

[56] References Cited

U.S. PATENT DOCUMENTS

| | | | |
|---|---|---|---|
| 3,773,098 | 11/1973 | Rock | 164/79 |
| 3,902,544 | 9/1975 | Flemings et al. | 164/71 |
| 4,310,352 | 1/1982 | Manfré et al. | 75/93 R |

FOREIGN PATENT DOCUMENTS

| | | | |
|---|---|---|---|
| 732073 | 5/1980 | Bulgaria | 222/606 |

*Primary Examiner*—L. Dewayne Rutledge
*Assistant Examiner*—Christopher W. Brody
*Attorney, Agent, or Firm*—Frost & Jacobs

[57] ABSTRACT

The device comprises a plurality of superimposed sectional plates each of which is provided with aligned holes defining a plurality of ducts lying in side-by-side relation, each of the ducts containing a plurality of helically twisted vanes which are angularly displaced with respect to one another at angles of substantially 90°.

7 Claims, 3 Drawing Figures

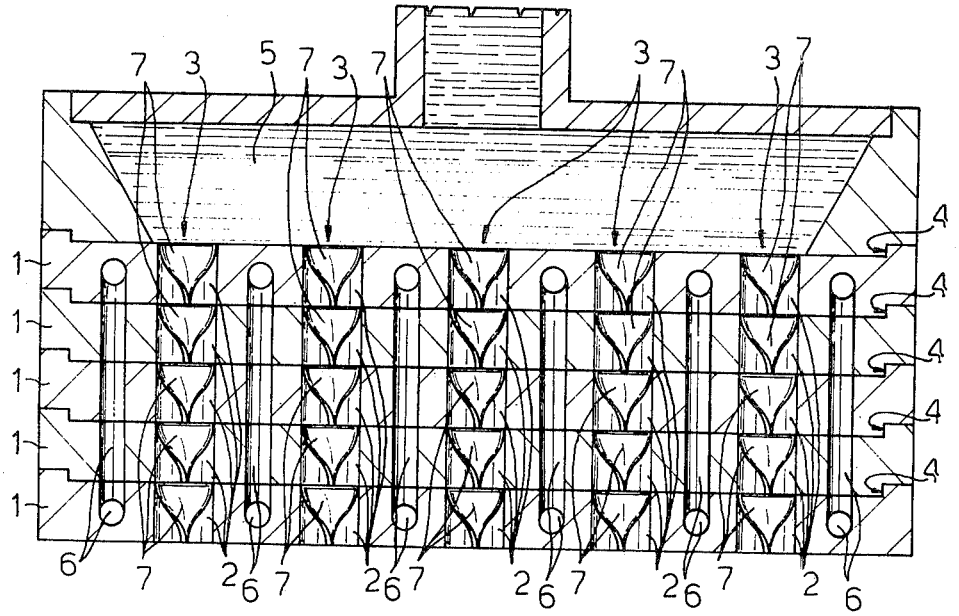
Fig.1
Fig.3
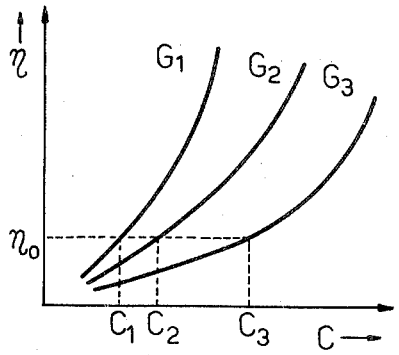
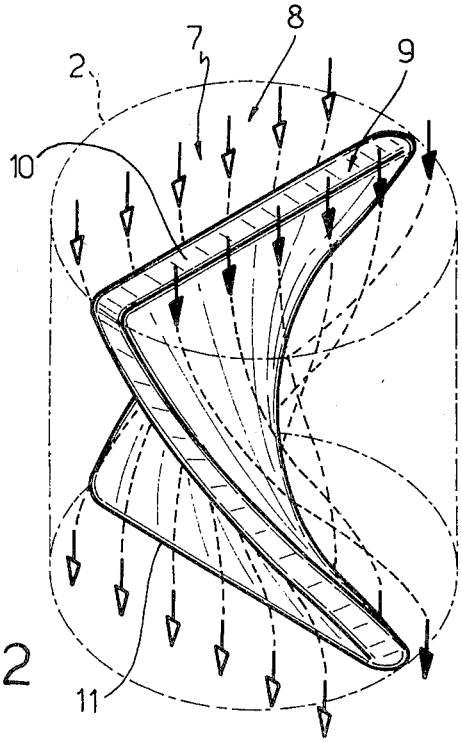
Fig.2

HIGH CAPACITY DEVICE FOR THE PREPARATION OF A MIXTURE COMPRISING A SOLID PHASE AND A LIQUID PHASE OF A METAL ALLOY

BACKGROUND OF THE INVENTION

The present invention relates to a device for the preparation of a mixture comprising a solid phase and a liquid phase of a metal alloy, of the type which is used in forming processes defined as "semi-liquid." It is known, in metallurgy that metal alloys have a temperature interval over which they solidify, the width of which interval is characteristic of the alloy itself. Above the upper end (liquidus point) of this interval the alloy is completely in the liquid state, while below the lower end (solidus point) the alloy is in the solid state. There are two phases present in the solidification interval, one liquid and the other solid, the relative quantities of these being a function of the temperature and the composition of the alloy itself.

In conventional solidification conditions the solid is present in dendritic form, that is to say in the form of tree-like skeletons characterised by main branches from which extend, perpendicularly, secondary, tertiary, etc. branches. Once the solid fraction reaches 20% the dendrites present form a continuous tree-like skeleton which raises the value of the viscosity beyond the acceptable limits for a casting operation.

Processes are known by means of which it is possible to prepare a mixture comprising a solid phase and a liquid phase of the metal material, in which while the concentration of the solid phase is rather high, it has the characteristic properties of a liquid, in particular a relatively low viscosity.

Such known processes tend to cause sliding between the various particles of the mixture held in movement in such a way as to break up, within certain limits, the dendritic interconnections which form during the solidification of the mixture, and to inhibit further increase in the dendrites themselves; in this way the dendritic fragments remain independent from one another and tend to assume spheroidal forms under the action of the continuous mechanical impacts.

The said sliding, which can be estimated by means of the relative velocity gradient, can be obtained internally both by means of a turbulent flow and by means of a laminar and stationary fluid current in which the various particles of the mixture move with a predetermined velocity dependent on the position which they have with respect to the walls of the cavity traversed thereby.

In a previous patent application by the applicant, filed on 16th June, 1980 and entitled: "Process for the preparation of a mixture comprising a solid phase and a liquid phase of a metal alloy, and device for its performance", now U.S. Pat. No. 4,310,352, three is described a device comprising a substantially cylindrical container in which there is formed a flow of the said mixture and within which there are disposed separation and conveyor means in the form of helical vanes, each of which is operable to divide the flow across it into at least two streams and to impart to each of these a substantially helical path; with this device the mixture is subjected to sliding actions and to very intense impacts with the consequence that the mixture leaving the device has a significantly high percentage of solid phase while the viscosity of the mixture itself is rather low.

It has been established that while entirely satisfactory results are being obtained with the described device, if the mixture has to have a predetermined and not very high viscosity, such as that necessary for making it suitable to be subjected to subsequent casting by means of die-casting technology, the said percentage of solid phase could not be increased beyond a certain value, limited to the order of 60%, if the device was dimensioned so as to obtain a rather high mixture flow rate, such as that required by an industrial installation of high productivity.

SUMMARY OF THE INVENTION

The object of the present invention is that of providing a device of the type described, which will allow a mixture having a low viscosity and a very high percentage of solid phase to be obtained and in particular above the first indicated limits, and which, simultaneously, shall be able to provide any rate of flow of mixture, even a very high one.

The device of the invention is characterised by the fact that it comprises a plurality of ducts which can be traversed by a flow of the said alloy, each of which is in communication with a supply reservoir of the alloy itself, there being disposed along each of the said ducts a plurality of helical vanes the longitudinal axes of which coincide with that of the duct itself and each of which is operable to divide the associated flow of material into at least two streams and to impart to each of these a substantially helical path, the diameter of each of the said ducts lying between 2 and 10 mm.

BRIEF DESCRIPTION OF THE DRAWINGS

For a better understanding of the device of the present invention a particular embodiment of it will now be described by way of example, with reference to the attached drawings in which:

FIG. 1 is a schematic longitudinal section of the device;

FIG. 2 is a perspective view of a helical vane which forms part of the device itself; and FIG. 3 represents a family of curves suitable for illustrating the behaviour of the device in use.

DETAILED DESCRIPTION OF THE INVENTION

The device substantially comprises a plurality of superimposable elements 1 in the form of plates, in each of which there is formed a series of holes 2 which traverse the element itself and which are disposed in any predetermined configuration. Therefore, when such elements are superimposed as in FIG. 1, with a pair of surfaces in contact, the various holes 2 define a plurality of ducts 3 which traverse the entire pile formed by the said elements.

The said superimposable elements can be delimited by any lateral surface whatsoever, for example, cylindrical, and for the purpose of holding them in the correct relative position there can be provided positioning and centering means of any type constituted, for example, by pairs of cylindrical surfaces 4 which can be coupled with one another as can be seen in FIG. 1, or else pins, rivets or the like.

The various ducts 3 are in communication with a reservoir 5 which can contain a predetermined quantity of an alloy in the liquid state; the alloy can come from a suitable melting furnace, and between the furnace and the said reservoir there can be arranged means for putting the alloy under pressure, such means being of the continuous or intermittently operating type, constituted, for example, in the first case, by a gear pump, and in the second by piston thrust means.

The assembly of superimposed elements 1 is cooled by suitable cooling means which will gradually cool the material which flows through the ducts 3 and to obtain, in each of the ducts, a predetermined temperature gradient $\Delta T/L$ defined as the variation of the temperature $\Delta T$ as a function of distance L travelled by the material flowing in the duct. For this purpose there can be formed suitable holes 6 in the elements 1 which form ducts forming part of a suitable cooling circuit.

The lower end of the duct 3 can be put in communication, by means not illustrated, with a machine for utilizing the mixture, such as a die-casting press or a mold in which the material can be collected.

Within each hole 2 of the element 1 there are arranged flow separation and conveyor means arranged to be traversed by the material which flows longitudinally through the holes themselves. Such means comprise a plurality of vanes 7 (clearly visible in FIG. 2) each of which operate to separate the flow of material which is supplied to it from upstream thereof into at least two independent streams 8 and 9 (FIG. 2) and to make each of these streams flow along a path such that, in each stream which is originated by a subsequent vane, there is contained flow parts of both the streams from the immediately preceding vane.

For this purpose each vane can conveniently have the form illustrated in FIG. 2, that is one obtained by helically twisting a plate in a direction parallel to the axis of the hole 2. The axial length of each vane and the pitch of the said helix are selected in such a way that the end edges, respectively the front edge 10 and the rear edge 11 of each vane, are rotated with respect to one another by 90°. It is evident that, in these conditions, the flow of material which traverses the hole 2 is subdivided by each vane 7 into two substantially equal streams 8 and 9 and that each of these is rotated, while it flows along the vane itself, by an angle of 90°.

The various successive vanes 7 are angularly offset from one another also by 90° as can be clearly seen in FIG. 1, such that the rear edge 11 of each of these is substantially orthogonal to the front edge 10 of the immediately subsequent vane.

The said vanes can be constructed from any materials which has physical and chemical resistance to the alloy which traverses it, for example, tungsten carbide, steel covered in ceramic material, graphite or the like; such vanes are fixed to the associated element 1 in any convenient manner, by suitable connection means, or they can be integrally formed with the element itself.

Although in the illustrated embodiment the various vanes 7 are helically twisted in the same sense, a device can be formed in which the vanes are alternatively disposed with left hand and right hand helices.

On the basis of the invention, and for purposes which will be further indicated below, the diameter of each hole 2 is rather small and lies between 2 and 10 mm, and the ratio between the axial length of the hole itself and its diameter is of the order of unity.

The operation of the device described is as follows.

A metal alloy, which is brought to the liquid state by melting, is supplied to a reservoir 5 at a suitable pressure, which is chosen in such a way as to overcome the fluid-dynamic resistances which the material itself encounters in traversing the ducts 3, so that the material leaves the lower ends of the ducts at a predetermined velocity.

The material present at the forward end of each duct, still in the completely liquid state, is subjected during the course of traversing the duct itself, to a progressive cooling obtained by means of the above indicated cooling means. The material which encounters the first vane 7 of any of the ducts is subdivided into two streams 8,9, indicated with the arrows shown in FIG. 2; during its traverse of the first vane each stream 8,9 is rotated substantially by 90° and therefore, when it is supplied to the subsequent vane, is separated by this into a further two streams. It is therefore evident that each stream which flows through one of the two channels defined by the second vane 7 of the duct is in reality constituted by material coming from the two streams 8 and 9 which have traversed each of the channels defined by the immediately preceding vane; similarly, when each thus constituted stream traverses the third vane it is further subdivided into two streams.

In conclusion, when the material traverses each of the vanes 7 it is subdivided into two independent streams, each of which is obtained by taking material from both the streams which flow from the immediately preceding vane.

While the alloy longitudinally traverses the ducts 3 it is being cooled, by the action of the cooling means, and tends to give rise to a mixture comprising a solid phase and a liquid phase in which the solid phase content tends to increase with the cooling, that is to say, the solid phase content gradually increases as the material advances along the ducts 3. The particles of material belonging to a stream line which forms each of the streams which traverse each vane 7 assume a predetermined velocity which obviously depends on the position which the stream line itself occupies with respect to the surfaces which delimit the associated stream (the surfaces of the vane 7 and of the hole 2); consequently, while the mixture flows past each of the vanes; it is subjected to a sliding action which depends obviously on the velocity distribution of the various stream lines of each stream. Such sliding can be estimated by the sliding gradient, defined by the ratio between the variation in the velocity between two stream lines and their distance. Because of this sliding between the various particles, which is correspondingly greater when the associated gradient is greater, the dendritic bonds which tend to form in the mixture of the material are broken progressively as the material advances along the vane, and the formation of new such bonds is inhibited.

As soon as the material leaves one vane and is supplied to the next it is located in a completely different velocity range dependent on the fact that the various particles now find themselves in stream lines the position of which, with respect to the surfaces which delimit the associated stream, is completely different from that in which were located the stream lines which, in the preceding vane, contained the same particles. In fact, if it is considered that, for example, a stream line which in the first vane is located in immediate proximity to the surface of the vane itself and not at the center thereof, and which therefore has a very low (almost nil) velocity because of its close proximity with this surface, when this stream line is supplied to the immediately subsequent vane, it is located substantially at the center of the stream which this vane generates, that is to say, at a much greater distance from the surface of the vane itself. It is therefore evident that a stream line in this position has a very much higher velocity than that of the corresponding stream line of the immediately preceding vane. This sharp velocity variation, to which the various particles are subjected in passing from one vane to the immediately subsequent vane, gives rise to a significant increase in the sliding gradient, with the advantage of significantly increasing the sliding and impacts between the particles belonging to the various stream lines and therefore of breaking up in a significant manner the dendritic bonds which tend to form in the solid phase of the material which is passing along each duct 3.

While the flow of material advances along each duct 3 it is also subjected to a temperature gradient $\Delta T/L$, that is to say, to a variation $\Delta T$ of temperature with variation in the distance L travelled by the alloy along each duct 3, which gives an idea of the rate of cooling along the duct itself.

It has been established by experimental tests performed on devices such as that of the invention, having ducts 3 with different diameters and working in various operating conditions, that the relation between viscosity $\eta$ of the mixture obtained and the concentration c of the solid phase in the mixture itself can be expressed by curves having the shapes represented in FIG. 3, in which each of the curves refers to a predetermined temperature gradient $\Delta T/L$ (or rate of cooling), maintained constant. The temperature gradient is a function above all of the diameter of the ducts 3, as well as of the operating conditions of the device (cooling efficiency, velocity of the alloy and like) and tends to increase with a reduction in the diameter thereof. The various curves of the family, distinguished with the reference letters $G_1$, $G_2$, $G_3$ are associated with progressively decreasing temperature gradients: it is therefore evident from these curves that, when it is desired to obtain a mixture with a very low predetermined viscosity $\eta_0$ (FIG. 3) and at the same time have a very high concentration of solid phase $C_3$, such conditions can be satisfied only with a device with which it is possible to also obtain the very low, temperature gradient (or rate of cooling) $\Delta T/L$ equal to $G_3$ (a device in which it is possible to obtain temperature gradients $G_2$,$G_1$ could produce a mixture with the same viscosity $\eta_0$, but only with a concentration of solid phase $C_2$,$C_1$ which is much less than $C_3$).

It is therefore evident from what has been explained that to obtain the favorable conditions described above it is necessary to make the material move through the ducts 3 with a low sliding velocity; however, the device also allows a very high rate of flow of mixture to be obtained, this depending solely on the number of ducts 3 (and therefore the number of holes 2) provided on the superimposable elements 1.

Therefore, because the device of the invention is able to provide mixtures having both a very low viscosity and a very high concentration of solid phase, well above that obtainable with known prior art devices, and with a rather high rate of flow, such devices are of interest for the formation of industrial processes.

Finally, the device is constructionally very simple and lends itself, by means of the addition or removal of superimposable elements 1, to adaptation to different mixture conditions.

It is evident that modifications and variations to the form and arrangement of the various parts of the described device of the present invention can be made without departing from the scope of the invention itself.

I claim:

1. A device for the preparation of a mixture comprising a solid phase and a liquid phase of a metal alloy in which the concentration of the solid phase has a predetermined value, characterized by the fact that it comprises a plurality of superimposable elements in the form of plates each of which is provided with a first series of through holes disposed in a predetermined configuration, the corresponding holes of said superimposable elements defining, when the elements are superimposed, a plurality of ducts lying in side-by-side relation, each of the ducts so formed being in communication with a supply reservoir for the alloy, whereby the ducts can be traversed by a flow of the alloy, there being disposed along each of the said ducts a plurality of helical vanes the longitudinal axes of which coincide with the longitudinal axis of the duct itself, each of which vanes acts to divide the associated flow of material into at least two streams and to impart to each such stream a substantially helical path, the diameter of each of the said ducts being between 2 and 10 mm.

2. A device according to claim 1, characterized by the fact that each of the said vanes has an axial length such as to impart to each of the said streams a rotation of 90°.

3. A device according to claim 1, characterized by the fact that the said vanes disposed in each duct are angularly displaced with respect to one another by substantially 90°, in such a way that the exit edge of each of the said vanes is substantially orthogonal to the input edge of the immediately successive vane.

4. A device according to claim 1, characterized by the fact that the ratio between the axial length of each of the said vanes and the diameter of the associated duct is substantially equal to unity.

5. A device according to claim 1, characterized by the fact that it includes means operable to provide a predetermined variation of temperature in the said material flowing along the axis of each duct, in such a way as to obtain a mixture in which the concentration of the solid phase has a predetermined value.

6. A device according to claim 5, characterized by the fact that said means operable to provide a predetermined variation of temperature comprise a second series of through holes in at least some of the superimposed elements, said second series of holes being operable to form circuits for the circulation of fluid held at a predetermined temperature and operable to obtain the said predetermined variation in temperature along the axis of each duct.

7. A device according to claim 1, characterized by the fact that each of the said vanes is constituted by a helically twisted plate.

* * * * *